United States Patent [19]

Greenberg

[11] 4,209,553

[45] Jun. 24, 1980

[54] METHOD AND APPARATUS FOR MAKING MATERIAL WITH A FUSIBLE BACKING

[76] Inventor: Robert Greenberg, 55 East End Ave., New York, N.Y. 10028

[21] Appl. No.: 953,370

[22] Filed: Oct. 23, 1978

Related U.S. Application Data

[60] Continuation of Ser. No. 827,017, Aug. 23, 1977, abandoned, which is a division of Ser. No. 653,596, Jan. 29, 1976, abandoned.

[51] Int. Cl.[2] ..... B05D 1/32; B05D 5/00

[52] U.S. Cl. ..... 427/179; 118/50; 118/301; 118/308; 427/179; 427/195; 427/197; 427/296

[58] Field of Search ..... 427/174, 176, 194, 197, 427/199, 188, 179, 195, 296; 118/301, 308, 312, 50; 222/189

[56] References Cited

U.S. PATENT DOCUMENTS

| | | | |
|---|---|---|---|
| 2,792,780 | 5/1957 | Jacob | 101/119 |
| 3,002,849 | 10/1961 | Harmon et al. | 118/50 X |
| 3,246,341 | 4/1966 | Childress et al. | 101/122 |
| 3,667,422 | 6/1972 | Saladin | 118/34 |
| 3,814,052 | 6/1974 | Caratsch | 118/60 |

FOREIGN PATENT DOCUMENTS

| | | | |
|---|---|---|---|
| 545451 | of 1942 | United Kingdom | 427/194 |
| 1222744 | of 1971 | United Kingdom | 427/197 |

*Primary Examiner*—Evan K. Lawrence
*Attorney, Agent, or Firm*—Kenyon & Kenyon

[57] ABSTRACT

A material with a fusible backing is made by bringing a substrate into contact with the outside of a rotatable printing screen having fine fusible polymer dust supplied to its inner side and then bringing the substrate out of contact with the screen and heating it from below to fuse the polymer to the substrate. The amount of dust falling out of the screen onto the substrate after the substrate leaves the screen is controlled by suctioning off a portion of the falling dust.

9 Claims, 6 Drawing Figures

PRIOR ART
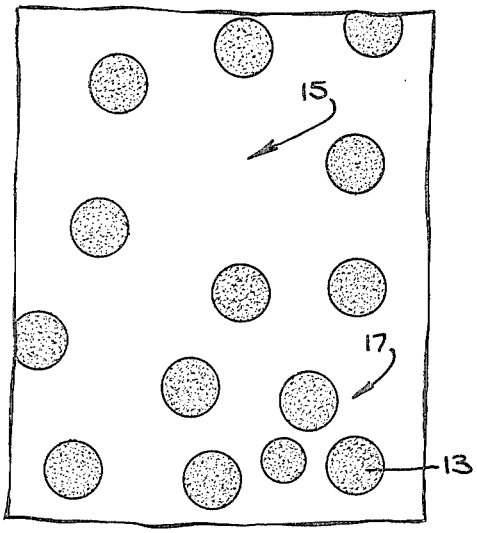
Fig.1.
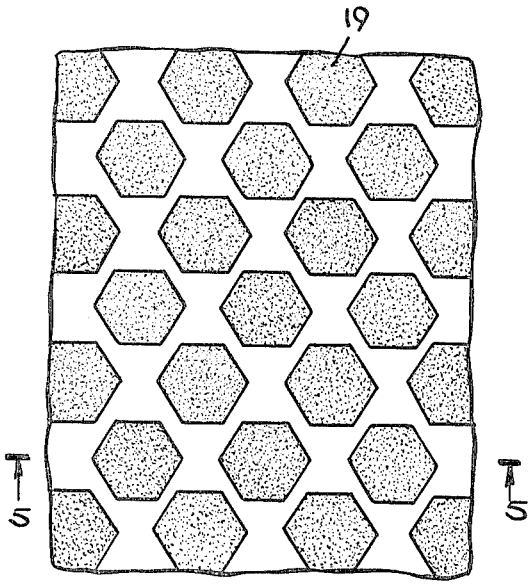
Fig.2.
Fig.5.
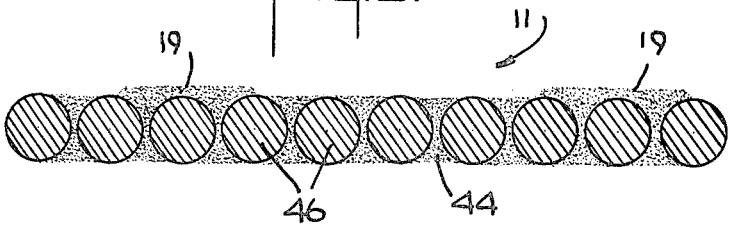
Fig.8.
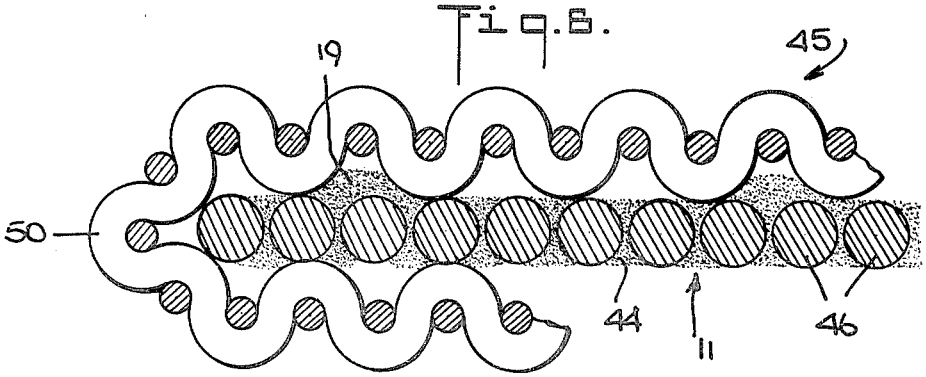

METHOD AND APPARATUS FOR MAKING MATERIAL WITH A FUSIBLE BACKING

This is a continuation of application Ser. No. 827,017, filed Aug. 23, 1977, now abandoned, which is a division of Ser. No. 653,596, Jan. 29, 1976, abandoned.

BACKGROUND OF THE INVENTION

This invention relates to the manufacture of material with a fusible backing in general and more particularly to an improved method and apparatus for making each fusible material using a dry printing process.

Fusible interlinings are universally used in the manufacture of various articles of clothing. In general, such interlinings comprise a lining substrate, e.g., woven fabric, nonwoven, paper knitted fabric, etc., having polymeric material deposited thereon to permit the fusible interlining to be attached to the garment without the need for sewing by means of fusion through simultaneous heating, pressing or the like. Similarly, fusible backing is used in making iron-on patches and the like.

Various methods have been developed in the prior art for making such fusible interlinings and the like, i.e. for applying the polymeric material to a substrate. Two general types of processes have been used. One is a random or scatter application of the polymer and the other method a discrete or controlled application. Most universally used is the random method in which a large number of particles are applied on a moving web. The polymer particles of a relatively large size are usually gravity fed from a feeder hopper located above the moving web which forms the substrate fabric. After being randomly coated with these particles, the web then passes under a heat source where the polymeric material is heated to its tackifying or melt point, after which it is calendered or pressed, cooled and then rolled up. The process is relatively simple and has been used to produce great quantities of fusible interlinings over the years. However, even with the development of highly usable polymeric materials such as polymide, tetpolymers, polymers, HDPE, urethanes, etc., the optimum application and functioning of a scatter product are limited because of the random laydown and the large particle size.

Discrete or controlled methods of applications are much less common even through the fusible product is superior in function and application. The primary reason for this is the increased difficulty in producing the fusible lining using known methods. In general, the controlled methods are printing methods. Both wet and dry printing methods have been used. A summary of the methods used is given in an article entitled "Copolymeric Nylon Powders for Fusing Textiles" by Schaaf in the November 1972 issue of American Dyestuff Reporter. More detail is given in a similar article by the same author titled "Lannion sin costra" reprinted from Textiles Panamericanos. In one method known as the powder point method a dry powder is doctored onto an engraved steel roll. The engraved dots are filled with the dry powder. The substrate is preheated and then pressed against the cool engraved steel roll causing particles of polymer to stick to the heated substrate so that the dry powder is lifted out of the engravings. Thereafter, the substrate with the polymer still virtually a powder moves into an area of high heat, normally an infra-red radiant heating system where the polymer is reheated to a high temperature to bring it to a semiplastic state after which calendering or pressing completes the process of attaching the molten polymer to the substrate. Even this process which comprises a large number of steps and results in a better product than the random method, has disadvantages. Since the polymer is primarily heated from above, the additional calendering or pressing step is necessary. Even with this step, the binding of the polymer to the substrate fabric does not reach an optimum. The above mentioned article from Textiles Panamericanos does describe a powder point process in which the engraved steel roll is followed by a heated roll.

A silk screen method is also known. An aqueous paste is squeezed through a rotary screen equipped with an adjustable squeegee. The material is then heated or sintered in an elongated infra red heating apparatus. In an alternate of this method power is dusted on the substrate resulting in a random application before heating. This arrangement requires a great deal of space and still does not obtain optimum bonding of the polymer material to the substrate. Typically infra-red ovens are 20 to 30 feet long.

In view of these variaous difficulties with prior art processes, the need for an improved process which is simpler and insures adequate bonding of the polymer to the substrate becomes evident.

SUMMARY OF THE INVENTION

The present invention provides a method and apparatus which solves these problems. In general terms, the present invention comprises bringing the substrate fabric at ambient conditions into contact with a printing screen which has a fine polymer dust applied to its other side and maintaining the fabric and a screen in contact for a sufficient time over a long enough distance for the polymer dust to be deposited on the substrate through all openings in the screen in the desired quantity. Thereafter the substrate is heated from below causing the polymer to fuse the substrate without the need for subsequent heat treatment.

A particularly advantageous embodiment of the invention is illustrated in which the printing screen is a conventional rotary textile print screen to the inside of which a fine polymer dust is fed from a hopper located thereabove. The substrate material is fed from a roll (or fed continuously) and held in contact with the printing drum over approximately 170° of its circumference to insure sufficient time for the polymer particles to fill all openings in the screen and contact the substrate. The substrate now covered with dots consisting of many particles of polymer dust thereon leaves the screen printing area and travels more or less horizontally and vibrationless to the heating area where it the passes over and around a heated drum which heats the substrate from below causing the polymer particles to fuse into a single large homogeneous dot and to be bonded to the substrate. It is then coaled and rolled up ready for delivery without further processing. Through this process, maximum coverage of the substrate with the discontinuous film of polymer, maximum utilization of the polymer, no imparting of undesirable hand to the substrate and extremely high in-plant production speeds with a simplfied process are possible. The process can be used with all types of substrates and polymers or blends of polymers. In particular, it should be noted that the present process can obtain speeds equal to that of the random or scatter process while obtaining better and more efficient coverage. Typically, scatter processes operate at 30–60 yards per minute whereas prior art powder-point processes normally operate at 9–10 yards per minute and are not known by applicant to have exceeded 15–25 yards per minute. The present apparatus has been operated at speeds in excess of 40 yards per minute with no problem. Furthermore, since elongated infra red heating ovens are not required, a particularly compact unit is obtained.

BRIEF DESCRIPTION OF THE DRAWINGS

FIG. 1 is a plan view of a fusible interlining manufactured using the prior art scatter process.

FIG. 2 is a plan view of similar material treated using the process of the present invention.

FIG. 5 is a cross section through the fusible interlining of FIG. 2.

FIG. 6 is a similar view illustrating the fusible interlining after attachment to another fabric.

DETAILED DESCRIPTION OF THE PREFERRED EMBODIMENT

Figure 3:
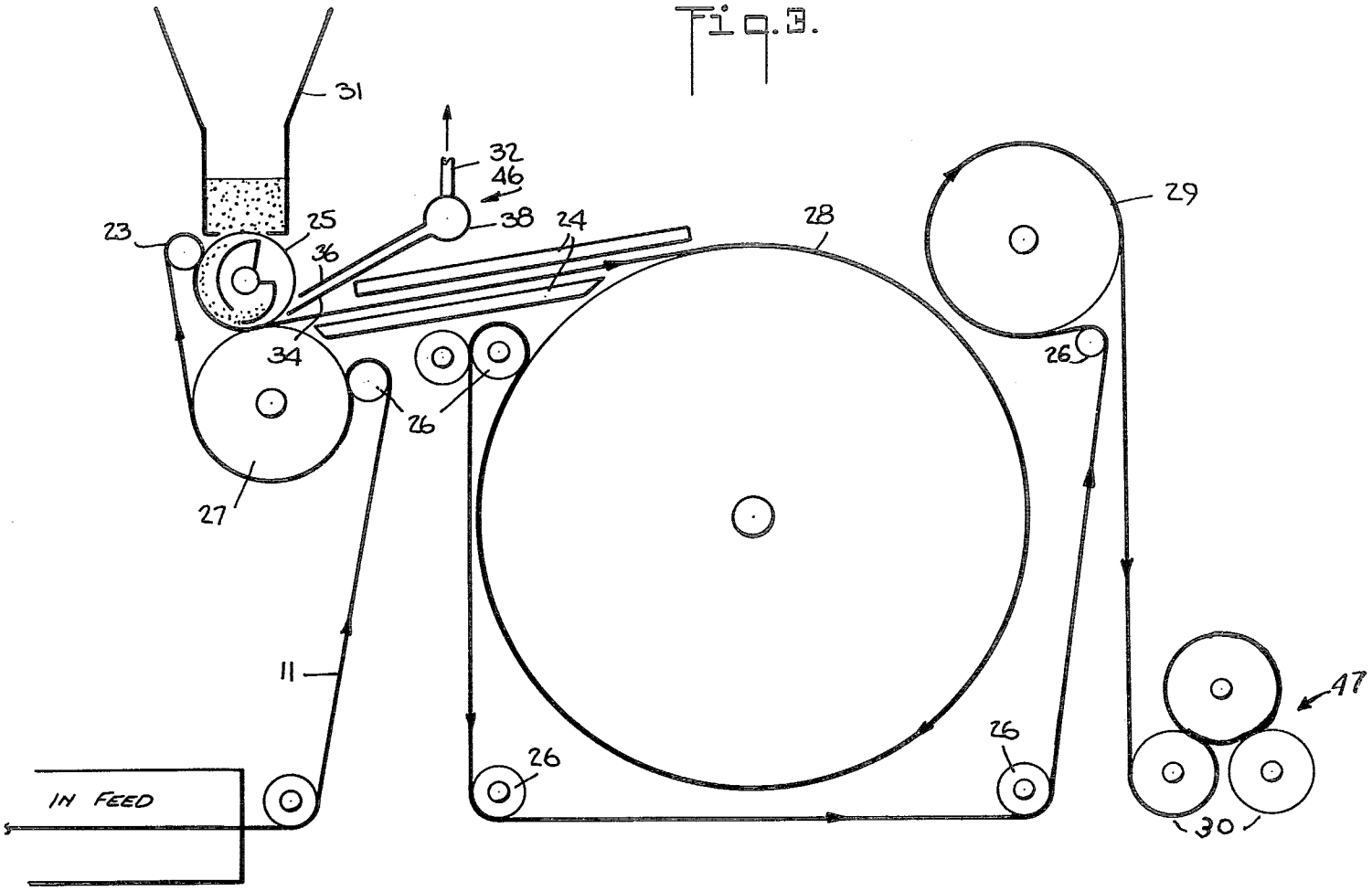
FIG. 3 is a schematic illustration of the processing apparatus of the present invention.

For purposes of comparison the effect obtained with the commonly used scatter process of the prior art is illustrated by FIG. 1. As shown, a plurality of polymer particles 13 are deposited in random fashion on a substrate fabric 11. Through this random deposit there will be relatively large areas such as the area 15 containing no polymer, whereas in other areas such as area 17 the polymer particles may become more closely packed than is desirable and sometimes overlap. Thus, this prior art method does not obtain even coverage, introduces the disadvantageous agglomerate and does not obtain maximum benefit of uniform adhesive for the amount of polymer used. Large sized particles are necessarily used so that the falling polymeric particles remain on the substrate surface and not fall into the cross section of the substrate or completely thru. Thus, very fine particles in the 1–80 micron range are virtually not practical or applicable unless the substrate is opaque otherwise, if the 1–80 micron range is used, the substrate is usually so completely coated as to constitute an continuous film.

The same substrate 11 treated with the printing process of the present invention is illustrated on FIG. 2. As indicated above, the process is carried out by maintaining the substrate in contact with a printing screen having supplied to its opposite side fine particles of polymer dust. The screen and substrate remain in contact long enough for the polymer dust to fill the openings in the screen and cover the full desired area on the substrate. Thereafter, the substrate is heated from below to bond the polymer to the substrate. The result, using a screen which have openings of hexagonal shape, is the deposit of polymer areas 19 is shown on FIG. 2. As illustrated, the areas where polymer is applied are evenly distributed and maximum utilization of the polymer is obtained.

The finished fused dot is the result of several steps. The printed dot directly after printing and before fusing consists of many separate polymer particles. Upon heating the particles melt and coalesce into a single large spherical dot due to the natural forces of cohesion and internal surface tensions. Therefor the shape of the unfused powder dot will generally be transformed into a sphere no matter were its dry state configuration. The shape of the screen openings are the result of the manufacturing method of screen preparation, i.e., the hexagonal shape is only an example of one particular screen.

Apparatus for carrying out this process is illustrated by FIG. 3. The substrate material to be processed will be conventionally supplied as a mill roll. The substrate fabric material, 11, is fed from the mill roll over a path which delivers the web to compression (melting idler roll) roll 26. The web passes between rolls 26 and 27 where the web is locked onto roll 27. The purpose of this is to feed or meter the web 11 to the rotating rolls 25 and 27 in perfect synchronization. This lock-step is essential for producing a perfect print. The web can be delivered from the print roll 25 at any rate independent of the downstream processing equipment speeds. The web is then brought into contact with the print screen 25 by the idler roll 23. The substrate 11 is maintained in contact with the printing drum 25 over approximately 170° of its circumference. The fabric is then wound over a heated drum 26, which heats the fabric from below to fuse the polymer thereto. As shown, it is wrapped almost completely around this drum to obtain maximum heated contact. After passing over idler rollers 26 it is wound over a cooling drum 29 and then rollers 31 at a rewind station 47 where it is rewound in a roll.

Fine free-falling polymer dust is fed by a hopper 31 to the top of printing drum 25 entering through the openings therein to the inside of the drum, as an alternate it can be internally fed to eliminate the external hopper. Also shown are optional heating means, e.g. infra-red heaters, 24 between drums 25 and 28.

Figure 4:
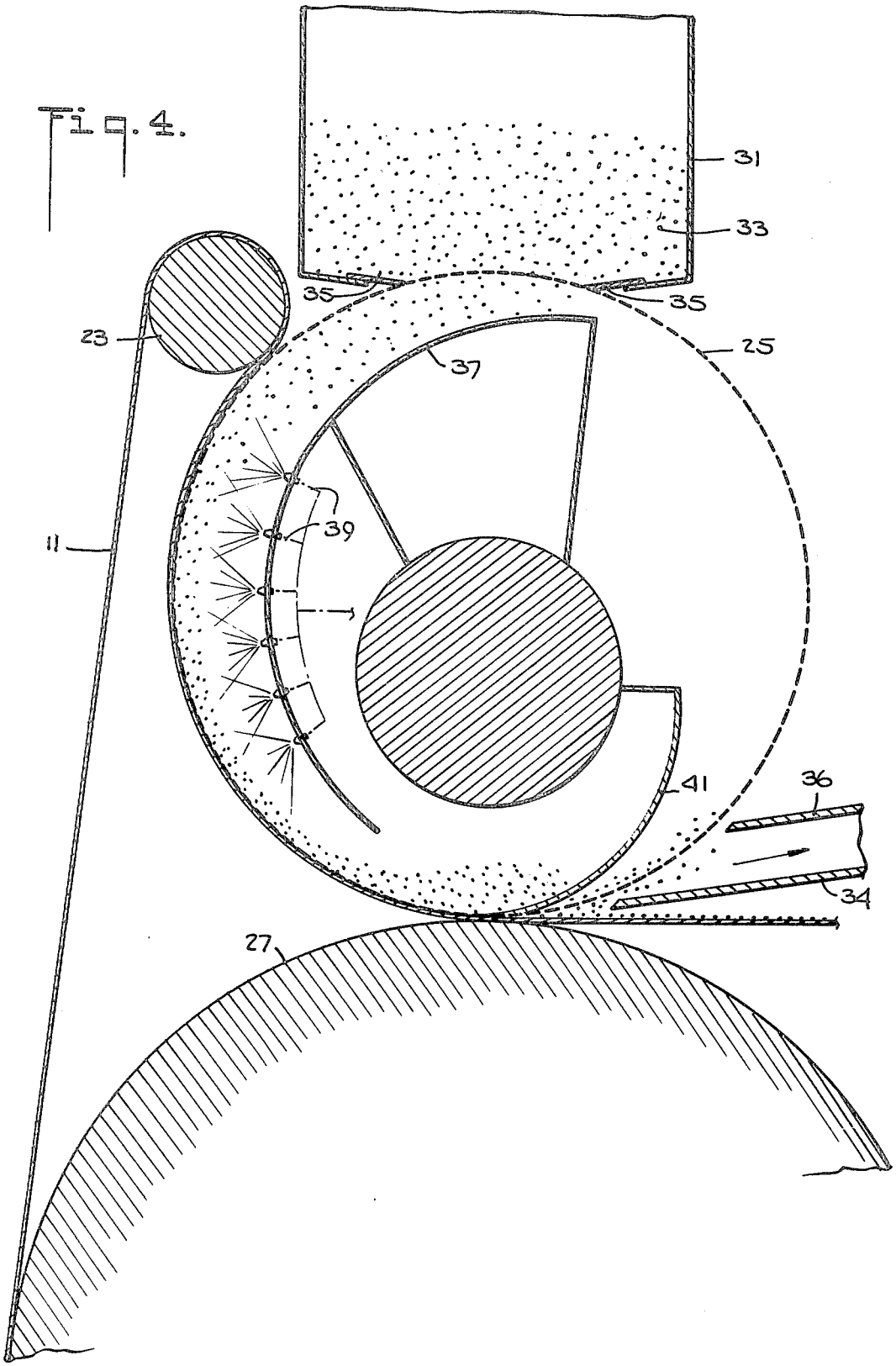
FIG. 4 is more detailed cross sectional view through the rotary printing screen of the apparatus of the present invention.

The operation of the printing drum can be better understood with reference to FIG. 4. Shown is the bottom of the hopper 31 which will contain therein an adequate supply of free-falling fine polymer dust 33. Associated with the bottom of the hopper 31 on each side is a doctor blade 35. These doctor blades 35, preferably of stainless steel, are made adjustable so that they can be brought into tangent contact with the screen drum 25 at any chosen point of tangent angle and contact pressure. The screen drum itself is a conventional rotary textile print screen. A suitable print screen is a 30 mesh, 25/1620 Stark Brabent commercial rotary print cressn. Although the present invention will operate with any polymeric material used for such purposes, e.g. see the various materials noted in the above literature references, polymide power of a particle size range of 1–80 microns and which is readily available commerically has been found to give good results.

As described above, the substrate 11 is brought over an idler roller 23 into contact with the edge of the printing screen 25. It is maintained in contact with the circumference of the screen 25 from that point to a point at its bottom where it contacts the large drum 27. Preferably, this distance is made as large as possible and as illustrated is approximately 170° of the printing drum's circumference. The fine polymer dust falls through the openings in the screen into the inside thereof. Inside the screen a flexible baffle plate 37 is provided to direct the falling polymer dust outward and downward into contact with the sides of the screen and through the screen openings into contact with the substrate 11. Although the centrifical force of the rotating drum along with the free-flowing powdery nature of the polymide will result in sufficient coverage with nothing further, a differential pressure between the inside and outside of the screen can further benefit this process. Means can be provided at the outside next to the substrate to draw a partial vacuum or, as illustrated, a plurality of air jets 39 fed from a conventional air supply, which aid in blowing the dust against the screen and thus bring it into contact with the substrate, may be used. Located at the bottom of drum 25 is a doctor blade 41. This doctor blade is arranged in a direction opposite to that which is normal in screen printing drums. Its function is to simply shear off excess powder rather than to extrude it as is normally done in paste printing or the dry power methods described above.

The dot coated substrate then leaves the bite of the print head and continues to move horizontally in a vibrationless manner to the heated drum 28 of FIG. 3. As it leaves, powder which has been carried past the doctor blade 41 drops through the screen and acts to evely coat the substrate with additional small particles. These get into the oenings of the cross section of the substrate and after heating act to strengthen the fabric.

Apparatus for controlling the amount of material which is allowed through the screen to randomly coat the substrate is illustrated on FIG. 3. This apparatus indicated generally as 46 includes a vacuum manifold 38 coupled to a conventional vacuum source over a line 32. Extending from the vacuum manifold is a bottom plate 34 and a top plate 36. In conventional fashion, these two plates will be closed off at their sides to form a slot which will draw a vacuum tending to suction off the particles as they fall from the drum 25. In conventional fashion, the system 46 will be mounted so that the distance between the end of the slot formed by the plates 36 and 34 and its angle can be adjusted with respect to the drum 25 to control the amounts of powder falling out of the drum 25 which are allowed to fall onto the substrate and the portion which is suctioned off by the vacuum system 46.

Heat is then applied by the drum 28 to the underside of the substrate and up through the substrate material to the underside of the polymer particles which melt and fuse to the substrate. By so bonding the polymer to the substrate, a superior bond between the substrate and polymer results as opposed to the commonly used prior method of applying heat from above. No calendering or pressing is required. As indicated in connection with FIG. 3, the finished material is cooled immediately on the drum 29 and can then be wound up for delivery to a customer.

The finished fusible interlining was described in connection with FIG. 2 which shows the pattern of polymeric material 19 on the substrate 11 after processing. A cross section of this material with the polymer material is shown on FIG. 5. This is the fusible interlining mateiral which is supplied to a customer who then uses it for ling other material.

Shown on FIG. 5 is the manner in which the small paritcles 44 get into the cross section of the fabric or substrate between the individual threads 46. In fact, very little of this powder which drops through the screen as it is carried past the doctor plate ends up on the surface of the fabric. As a result, it has no particular effect on the normal fusing of the substrate to another fabric, e.g. a shell fabric. However, this does permit carrying out a special process which is illustrated on FIG. 6. In the first instance, the user applies the fusible liner comprising the substrate 11 with the dots of polymer 19 thereon with the polymer side down to a fabric 45 to be lined. Thereafter heat may be applied through pressing or the like to bond the two fabrics together without sewing. However, the presence of the small particles 44 within the cross section of the materials permits a further operation to be carried out as shown on the lefthand side of FIG. 6. As illustrated, the material 45 is longer than the substrate 11 and is brought around to the other side of the substrate. The top of the material to which the substrate is attached is the portion of the material which will be visible when the article of clothing is worn or the material used for some other purpose. The side 49 is the back of the material. Because these particles 44 penetrate the cross section of the substrate 11 they are available for this important crease and band operation so that the edge 50 of the fabric 45 be brought around and tacked in place to the back of the substrate. Thus, the substrate produced by the present invention satisfies the double requirement of a full normal fusing plus the vitally important fusing which is used in the creasing and banding operation. The product is ideally suited initially for top fusing using the dots 19 which are normally a 30 mesh dot application. Furthermore, the additional property of bleed back due to the inclusion of the individual polymer particles 44 in the cross section of the substrate permits the refusing. It is also through that the large dots during the pressing are caused to completely penetrate the fabric and aid in this refusing in the crease and band process.

Thus, an improved method for manufacturing a material with a fusible backing, such as fusible interlinings and iron on patches, and apparatus for carring out that method has been shown. Although specific embodiments have been illustrated and described, it will be obvious to those skilled in the art that various modifications may be made without departing from the spirit of the invention which is intended to be limited solely by the appended claims.

I claim:

1. A method for manufacturing material with a fusible backing comprising:

(a) bringing a lining substrate into contact with the outside of a rotatable screen print drum over a substantial portion of its circumference, and in such a manner that the substrate material is free of any underlying support at least over most of said substantial portion by steps comprising:

i. disposing a rotating roll such as to contact said substrate at a point near the bottom of said drum so as to hold it in contact therewith;

ii. disposing a first idler roller so as to contact said substrate at a point above said rotating roll holding the substrate in contact with said print drum thereby establishing contact with said substrate over a substantial portion of said print drum;

iii. partially wrapping said substrate around said rotating roll prior to supplying said substrate to said first idler roll by disposing a second idler roll such as to hold said substrate in contact with said rotating roll, whereby the substrate will be fed to the printing drum by the rotating roll in perfect synchronization to obtain lock step operation;

(b) supplying a fine free-flowing fusible polymer dust to the inside of said drum by gravity through the screen thereof by disposing a hopper above the top of said drum, said substantial portion at which said substrate is in contact with said print drum extending from a point below said hopper on one side of said drum to the bottom of the drum, to thereby apply said fine free-flowing polymer dust to said drum and through said drum to said substrate over said bottom;

(c) bringing said substrate with said polymer dust thereon out of contact with said screen at the point where said rotating drum contacts said substrate;

(d) scraping excess polymer from the inside of said drum at the point where said substrate is brought out of contact with said drum; and (e) heating said substrate and polymer dust to fuse said polymer dust to said substrate material.

2. The method according to claim 1 wherein said first idler roll is disposed at a point which is approximately 170° away from the point where said rotating roll contacts said substrate.

3. The method of claim 1 and further including the step of permitting a portion of the polymer dust to freely fall out of said print drum onto said substrate after it has left the bite of said drum, said small particles of polymer dust falling onto said substrate and into the cross section thereof between fibers.

4. The method of claim 3 and further including the step of controlling the amount of polymer dust which is permitted to reach said substrate by suctioning off at least a portion of the polymer dust which falls out of the print drum after said substrate is brought out of contact with said print drum, to thereby control the amounts of dust falling out of the drum which are allowed to fall onto the substrate.

5. The method of claim 1 wherein said heating comprises heating said substrate from below.

6. The method of claim 5 wherein said heating from below is carried out by passing said substrate with polymer deposited thereon over a heated drum after it leaves the surface of said printing drum.

7. The method of claim 6 and further including the step of winding the finished material after heating.

8. A method for manufacturing material with a fusible backing comprising:

(a) bringing a lining substrate into contact with the outside of a rotating screen print drum such as to maintain the substrate in contact with said drum over a substantial portion of its circumference, and in such a manner that the substrate material is free of any underlying support at least over most of said substantial portion;

(b) supplying a fine free-flowing fusible polymer dust to the inside of said drum by gravity through the screen thereof by disposing a hopper above the top of said drum, said substantial portion at which said substrate is in contact with said print drum extending from a point below said hopper on one side of said bottom, to thereby apply said fine free-flowing polymer dust to said drum and through said drum to the substrate over said bottom of the drum;

(c) bringing said substrate with said polymer dust thereon out of contact with said drum at the said bottom;

(d) scraping excess polymer from the inside of said drum at the point where said substrate is brought out of contact with said drum;

(e) heating said substrate and polymer dust to fuse said polymer dust to said substrate material; and (f) deflecting said polymer dust supplied to the inside of said drum from above so as to cause contact with said drum on the inside over said substantial portion to insure filling the holes therein when operating at high speed.

9. A method for manufacturing material with a fusible backing comprising:

(a) bringing a lining substrate into contact with the outside of a rotating screen print drum such as to maintain the substrate in contact with said drum over a substantial portion of its curcumference, and in such a manner that the substrate material is free of any underlying support at least over most of said substantial portion;

(b) supplying a fine free-flowing fusible polymer dust to the inside of said drum to thereby apply said fine free-flowing polymer dust to said drum and through said drum to said substrate over said substantial portion;

(c) bringing said substrate with said polymer dust thereon out of contact with said drum;

(d) scraping excess polymer from the inside of said drum at the point where said substrate is brought out of contact with said drum;

(e) heating said substrate and polymer dust to fuse said polymer dust to said substrate material; and (f) controlling the amount of material which is allowed to pass through said screen print drum and to randomly coat the substrate by suctioning off at least a portion of the polymer dust which falls out of the print drum after said substrate is brought out of contact with said print drum, to thereby control the amounts of dust falling out of the drum which are allowed to fall onto the substrate, whereby operation at high speed without an uncontrolled fall out of the polymer dust remaining in said screen is possible.

* * * * *